US007679021B2

(12) United States Patent
Gericke et al.

(10) Patent No.: US 7,679,021 B2
(45) Date of Patent: Mar. 16, 2010

(54) SWITCHING DEVICE

(75) Inventors: Joachim Gericke, Berlin (DE); Volker Lehmann, Treuenbrietzen (DE); Andrzej Nowakowski, Berlin (DE); Klaus Schuler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/578,523

(22) PCT Filed: Nov. 2, 2004

(86) PCT No.: PCT/DE2004/002455

§ 371 (c)(1),
(2), (4) Date: May 8, 2006

(87) PCT Pub. No.: WO2005/048281

PCT Pub. Date: May 26, 2005

(65) Prior Publication Data

US 2007/0074963 A1 Apr. 5, 2007

(30) Foreign Application Priority Data

Nov. 11, 2003 (DE) ..... 103 53 497

(51) Int. Cl.
*H01H 9/30* (2006.01)

(52) U.S. Cl. ..... 218/48; 218/16; 218/65; 218/146

(58) Field of Classification Search ..... 218/13, 218/16–21, 48–50, 65, 74, 123–128, 130–133, 218/146; 200/262–270
See application file for complete search history.

(56) References Cited

U.S. PATENT DOCUMENTS

| | | | | |
|---|---|---|---|---|
| 2,504,906 | A | 8/1950 | Tremblay | |
| 3,588,433 | A * | 6/1971 | Woodlyn et al. | 200/264 |
| 5,846,655 | A | 12/1998 | Henning et al. | |
| 6,211,478 | B1 | 4/2001 | Schoenemann et al. | |
| 6,462,295 | B1 * | 10/2002 | Knobloch et al. | 218/48 |
| 6,646,850 | B1 * | 11/2003 | Bergmann et al. | 218/53 |

FOREIGN PATENT DOCUMENTS

| | | |
|---|---|---|
| CN | 1245964 A | 3/2000 |
| DE | 837 866 | 11/1952 |
| DE | 765 599 | 4/1954 |
| DE | 42 30 060 A1 | 3/1994 |
| DE | 195 30 512 C1 | 10/1996 |
| DE | 197 47 840 A1 | 5/1999 |
| DE | 19837945 A1 | 2/2000 |
| EP | 0 982 748 A1 | 3/2000 |

* cited by examiner

*Primary Examiner*—Renee S Luebke
*Assistant Examiner*—Marina Fishman
(74) *Attorney, Agent, or Firm*—Laurence A. Greenberg; Werner H. Stemer; Ralph E. Locher

(57) ABSTRACT

An electrical switching device, especially a high-voltage circuit breaker, contains arcing contacts and nominal current contacts. At least one of the nominal current contacts has a surface formed of an arc-resistant material provided with a galvanic coating. In this configuration, the contact points can withstand high mechanical and thermal loads and at the same time maintain a high current carrying capacity.

8 Claims, 3 Drawing Sheets

10
11
10
11
10
11

SWITCHING DEVICE

BACKGROUND OF THE INVENTION

Field of the Invention

The invention relates to a switching device having a first and a second arcing contact piece, which lie axially opposite one another, and a first and a second rated current contact piece, which are arranged coaxially with respect to the arcing contact pieces, at least one of the rated current contact pieces having a hollow-cylindrical basic body; which is covered at the front by an arc-resistant material at its end facing a switching path of the switching device.

Such a switching device has been disclosed, for example, in the European patent application EP 0 982 748 A1. Therein, the arcing contact pieces are covered by an arc-resistant material by means of plasma spraying such that an arc drawn between the arcing contact pieces does not cause any erosion, or only causes a very low amount of erosion. Furthermore, the rated current contact pieces likewise have an erosion-resistant protective coating, which is applied by means of plasma spraying, in sections on their sliding faces. The stationary rated current contact piece is silver-plated on top of the erosion-resistant protective coating.

When two or more materials; such as the erosion-resistant material, the electrically conductive silver and a further metal such as the aluminum of the rated current contact piece, impact against one another, the respective points of impact always have irregularities. The point of impact can only be subjected to a mechanical load to a reduced extent. Surface friction occurring in the event of the sliding faces of the rated current contact pieces running against one another can result in disintegration phenomena and thus in a weakening of the individual layers. It is thus possible for individual layers to be chipped off starting from the point of impact. This reduces the switching capacity of the switching device.

SUMMARY OF THE INVENTION

The invention is based on the object of designing a switching device of the type mentioned initially such that the contact points withstand high mechanical and thermal loads while having a high current-carrying capacity.

The object is achieved according to the invention in the case of the switching device of the type mentioned initially by the fact that the arc-resistant material has an electroplating.

The electroplating may consist, for example, of an electrically highly conductive material, such as silver or gold. This reduces the contact resistance of the electrical contact. At the same time, the electroplating prevents oxidation on the arc-resistant material in the event that the individual components are stored for a relatively long period of time. By including the arc-resistant material in an electroplating treatment process, it is possible to cover points of impact or boundary layers of different materials, which improves the mechanical loadability and the mechanical endurance of these points.

One advantageous refinement can furthermore provide for the arc-resistant material to be fixed to the hollow-cylindrical basic body in the form of a ring, so as to cover front faces of the hollow-cylindrical basic body.

Owing to the fact that the front faces of the hollow-cylindrical basic body are covered, the electric field in the direction of the switching path of the switching device is substantially controlled by the form of the ring. This results in the possibility of using manufacturing methods for manufacturing the basic body with a lesser degree of precision, for example a reduced surface quality, than in the case of the ring used for field control. Furthermore, it is possible to equip the basic body with various ring forms so as to achieve various electric field effects in the region of the switching path of the switching device. Furthermore, when the front faces of the hollow-cylindrical basic body are completely covered, the basic body itself is protected against the effect of a switching arc. It is thus possible for an arc to act on many points on the ring. The stability of the ring is thus increased. Splitting into a hollow-cylindrical basic body and a ring also furthermore has the advantage that the hollow-cylindrical basic body can be produced, for example, from a material having a low density, such as aluminum, as a result of which the total mass of the hollow-cylindrical basic body and the arc-resistant material fixed thereto is reduced. Arc-resistant materials are, for example, mixtures of molybdenum (Mo), tungsten (W), copper (Cu) and silver (Ag). For example, CuCrZr, CuZn39Pb3 or Ecu57 can be used for the arc-resistant material. These materials have a very high density, which results in the ring having a comparatively high mass. In particular in the event of a movement of the rated current contact piece equipped with the arc-resistant material, the multi-part design of the rated current contact piece limits the mass to be moved.

Provision may advantageously further be made for the ring to have a smaller radial wall thickness at its end facing away from the switching path than at its end facing the switching path.

Owing to the high density which has already been mentioned above, even small components consisting of an arc-resistant material have a comparatively high mass. A reduction in the wall thicknesses to the absolute minimum required therefore makes it possible to make savings on the arc-resistant material. Furthermore, in the case of a stepped design of the ring, in which the end facing the switching path has a greater wall thickness than the end facing away from the switching path, it is possible for the ring to be pushed onto the hollow-cylindrical basic body in a simple manner. Owing to this design for the form of the ring, it can be pushed onto the hollow-cylindrical basic body automatically in a centering manner. This simplifies assembly. At the same time, the points of the hollow-cylindrical basic body and the arc-resistant ring which are coming into contact with one another are increased in number owing to the enlarged area. Owing to an increased number of contact points, the electrical contact resistance between the arc-resistant ring and the hollow-cylindrical basic body is reduced.

One further advantageous refinement may provide for the ring to be pressed against the hollow-cylindrical basic body of the rated current contact piece in the axial direction by means of a bolt connection.

A bolt connection in the axial direction between the ring and the hollow-cylindrical basic body makes it possible to keep the outer contours of the ring and the hollow-cylindrical basic body free from drilled holes or other fixing means. The outer contour of the rated current contact piece is thus maintained. Furthermore, owing to an arrangement of the bolt connections in the axial direction in the interior of the hollow-cylindrical basic body, a sufficient volume remains free for accommodating, for example, further assemblies or for deflecting or guiding the quenching gas flows occurring in the event of a switching operation in the interior. Threaded rods, screws, pressed or crimped bolts or bolts which have been adhesively bonded-in etc. can be used for bolting purposes. In this case, the bolts form a type of cage with their longitudinal axes parallel to the cylinder axis of the hollow-cylindrical basic body. Owing to an even distribution over the circumference of the hollow-cylindrical basic body, the ring can be pressed uniformly against the hollow-cylindrical basic body.

One further advantageous refinement may provide for the hollow-cylindrical basic body to have a radical projection, against which an insulating body, in particular an insulating material nozzle, is pressed axially by means of a pressure element.

The radial projection represents a fixed stop for the insulating body. The position of the insulating body with respect to the hollow-cylindrical basic body is thus clearly fixed. The incorporation of the insulating body takes place by means of a pressure element over a short period of time. Additional measurements, adaptations or adjustments of the insulating body are thus not required. An annular disk, which transfers the contact-pressure force evenly over the insulating body, can be used, for example, as the pressure element. In this case, it is advantageous if the radial projection is likewise designed to be annular and circumferential.

Provision may advantageously also be made for the hollow-cylindrical basic body to have a reduced outer diameter at its end facing the switching path and for the radial projection to be arranged on the hollow-cylinder inner casing in the region of the reduced outer diameter.

With such an arrangement of the radial projection, a sufficient distance is produced between the contact-pressure cheeks of the projection and the pressure element to make advantageous use of the intrinsic elasticity of the insulating body material. Owing to thermal influences, expansions or shrinkages of the insulating material result. It is therefore necessary when using a clamping connection to cover a sufficient insulating body volume. Only in this manner is it possible for sufficient holding force to act on the insulating body in the case of various thermal loads. A clamping region which is too small would not be suitable for permanently applying the required forces. Furthermore, the insulating body can be stopped very close to the front of the hollow-cylindrical basic body. The required physical length for the total construction of fixing the erosion-resistant ring and the insulating material nozzle to the hollow-cylindrical basic body is thus reduced.

A further advantageous refinement may provide for the ring to have fixing devices in the region of its enlarged radial wall thickness.

Sections having an enlarged wall thickness make it possible to flexibly select the location of fixing devices. At the same time, such sections have a comparatively high mechanical strength. For example, threaded holes or other anchoring points may be provided as the fixing devices.

Provision may advantageously be made for contact-making points between the two rated current contact pieces to lie axially in the region of the arc-resistant material in the switched-on state of the switching device.

An arrangement of the contact-making points of the two rated current contact pieces in the region of the arc-resistant material prevents, from the outset, a situation in which the individual contact faces need to be moved over joints during a switching operation. As a result, the joints are protected against mechanical loading resulting from the corresponding contact parts of the rated current contact pieces being pushed on and pushed away. For this reason it is possible to manufacture the joints with increased tolerance. It is barely possible for an electroplating to be removed at this joint owing to mechanical loading of the rated current contact pieces. The robustness of the contact pieces of the switching device is thus improved.

The invention will be shown schematically in a drawing and described in more detail below with reference to an exemplary embodiment.

DESCRIPTION OF THE PREFERRED EMBODIMENTS

Figure 1:
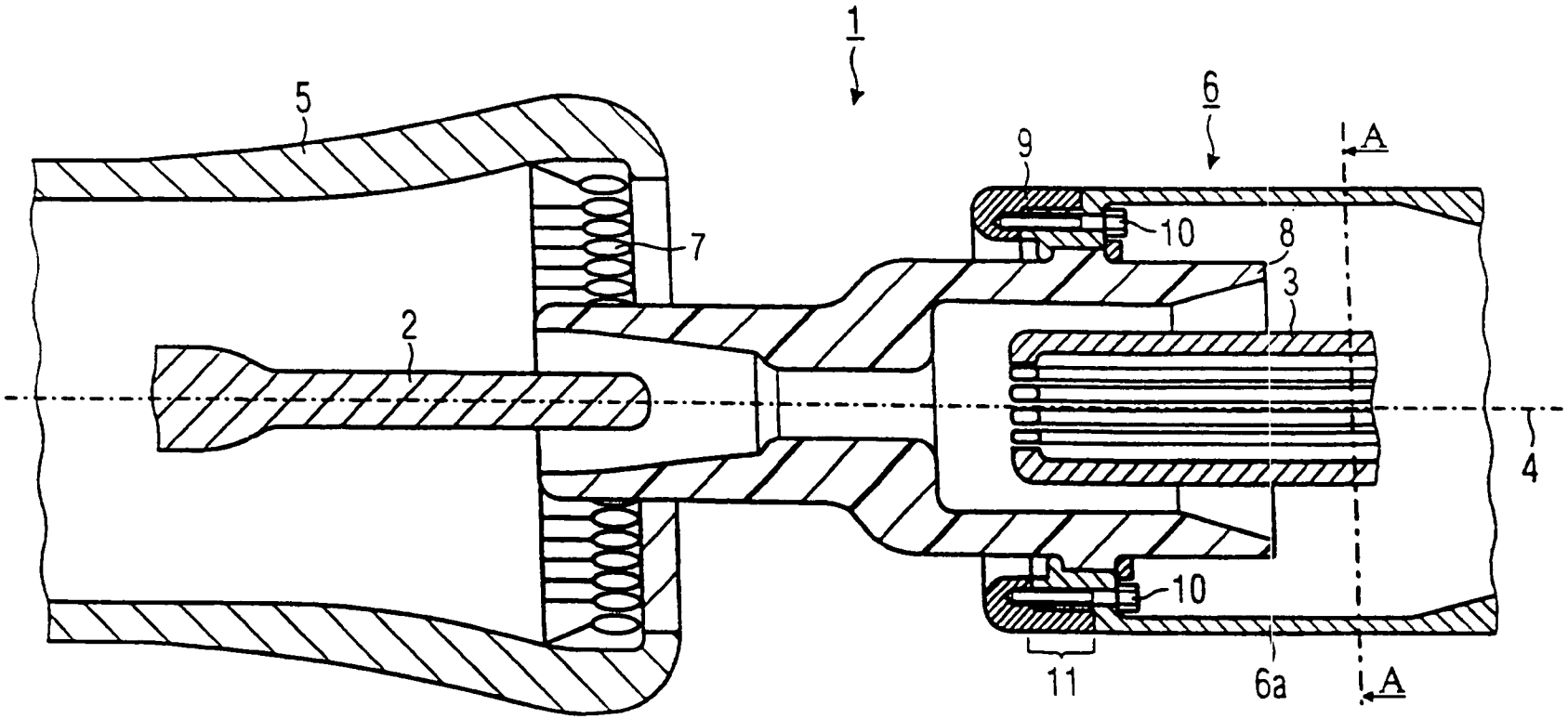
FIG. 1 shows a section through a switching device.

The switching device illustrated in FIG. 1 is a high-voltage power breaker 1. A high-voltage power breaker 1 is used to switch rated currents and short-circuit currents. The high-voltage power breaker 1 has a first arcing contact piece 2 and a second arcing contact piece 3. The first arcing contact piece 2 is essentially cylindrical and has a coating of an arc-resistant material at its end facing the switching path of the high-voltage power breaker 1. The second arcing contact piece 3 is in the form of a tulip contact, in which the first arcing contact piece 2 can be inserted. At its end facing the switching path, the second arcing contact piece 3 likewise has a coating of arc-resistant material. The two arcing contact pieces 2, 3 are arranged axially opposite one another on a main axis 4. A first rated current contact piece 5 is arranged concentrically with respect to the first arcing contact piece 2. A second rated current contact piece 6 is arranged concentrically with respect to the second arcing contact piece 3. The first rated current contact piece 5 has a large number of elastic contact fingers 7 at its end facing the switching path, said contact fingers 7 being in electrically conductive contact with the outer casing of the second rated current contact piece 6 in the closed stated of the high-voltage power breaker 1. Furthermore, the second arcing contact piece 3 is surrounded by an insulating material nozzle 8. The insulating material nozzle 8 is held on the second rated current contact piece 6. The rated current contact pieces 5, 6 and the arcing contact pieces 2, 3 can be moved in relation to one another along the main axis 4, to be precise such that, in the case of a switch-on operation, initially the arcing contact pieces 2, 3 and then the rated current contact pieces 5, 6 come into contact with one another. In the event of a switch-off operation, initially the rated current contacts 5, 6 open, and then the arcing contact pieces 2, 3 are isolated from one another. The second rated current contact piece 6 has an essentially hollow-cylindrical basic body 6*a*. The hollow-cylindrical basic body 6*a* is covered at the front by a ring 9 of an arc-resistant material. The ring likewise has an essentially hollow-cylindrical structure, the hollow cylinder top face, which faces the switching path of the high-voltage power breaker 1, being rounded off. Furthermore, the wall thickness of the ring 9 on the side facing away from the switching path is less than on its side facing the switching path. In the present exemplary embodiment, this is achieved by the inner diameter of the ring 9 being enlarged on its side facing away from the switching path. Furthermore, a conical or parabolic profile of the inner casing surface of the ring 9 or other suitable geometric shapes can also be used. The hollow-cylindrical basic body 6*a* has a reduced outer diameter at its end facing the switching path. The reduced outer diameter of the hollow-cylindrical basic body 6*a* and the enlarged inner diameter of the ring 9 are matched to one another such that the ring 9 can be pushed onto the hollow-cylindrical basic body 6*a*. In order to press the ring 9 against the hollow-cylindrical basic body 6*a*, the ring 9 has a plurality of threaded holes, into which bolts 10 can be screwed. The bolts 10 are supported in each case at edges of cutouts, which are arranged distributed symmetrically, parallel to the main axis 4, in the casing of the hollow-cylindrical basic body 6*a*. The surface of the ring 9 is electroplated. This electroplating is, for example, a silver plating. The hollow-cylindrical basic body 6*a* is likewise provided with an electroplating. In the switched-on state of the high-voltage power breaker 1, the contact points of the electrical contact fingers 7 rest in the region 11 of the ring 9. Owing to the arrangement of the ring 9 of an arc-resistant material, high switching powers can also be controlled, in the case of which switching arcs occur, despite the use of arcing contact pieces, even on the rated current contact pieces. The use of the arc-resistant ring 9 allows for a compact design of a high-voltage power breaker.

Figure 2:
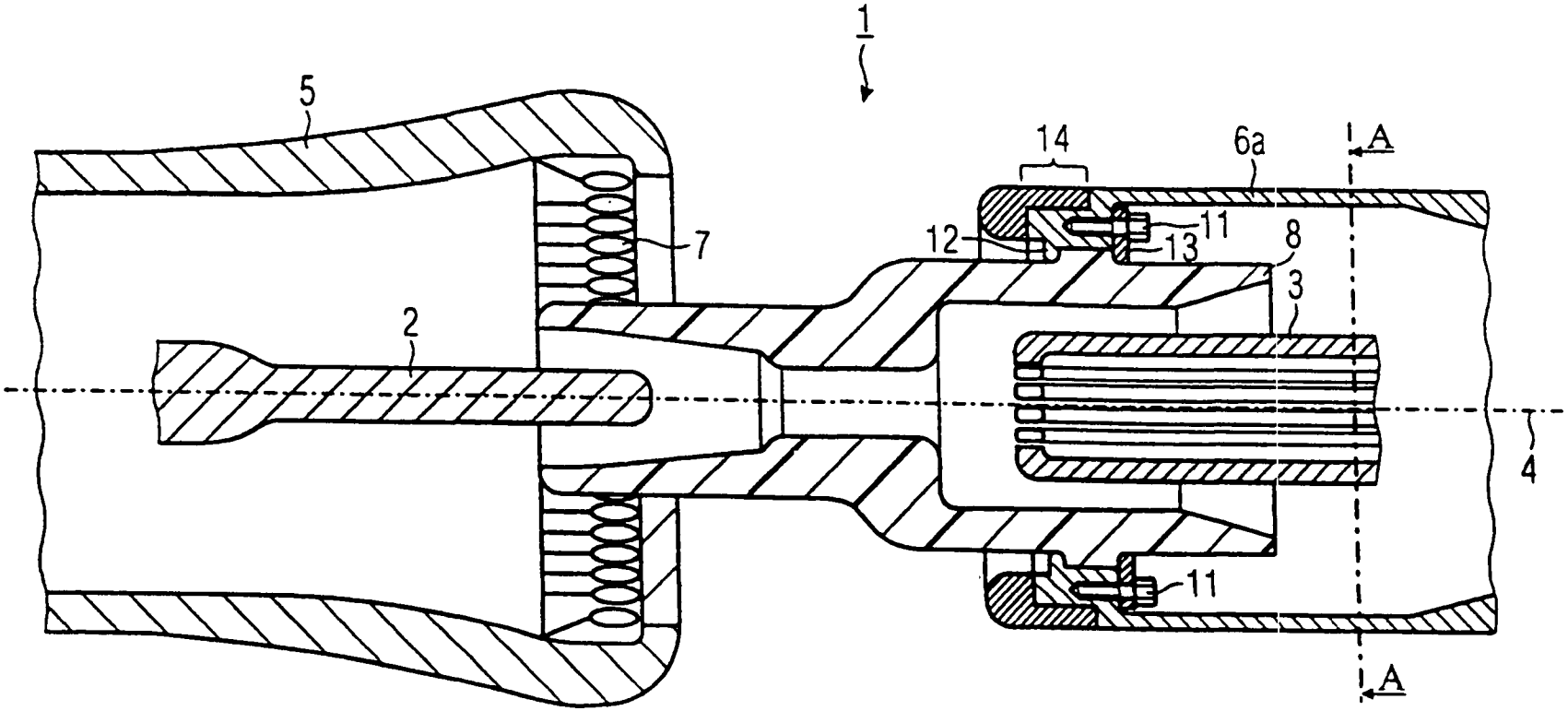
FIG. 2 shows a further section through the switching device.

FIG. 2 illustrates a section through the high-voltage power breaker 1 known from FIG. 1. However, the sectional plane is pivoted about the main axis 4 such that it is now possible to see the fixing of the insulating material nozzle 8. The insulating material nozzle 8 is held by means of further bolts 11, which can be screwed into threaded holes in the essentially hollow-cylindrical basic body 6*a*. In this case, the threaded holes are aligned such that the further bolts 11, just like the bolts 10, are arranged parallel to the main axis 4. The hollow-cylindrical basic body 6*a* has an annular projection 12. A circumferential shoulder of the insulating material nozzle 8 is pressed against the annular projection 12. The contact-pressure force of the shoulder against the annular projection 12 is produced by means of a pressure element 13 in the form of a pressure disk, which is held by the further bolts 11. The annular projection 12 is arranged on the inner casing side of the essentially hollow-cylindrical basic body 6*a*, to be precise in the section 14 in which the outer diameter of the hollow-cylindrical basic body 6*a* is reduced.

Figure 3:
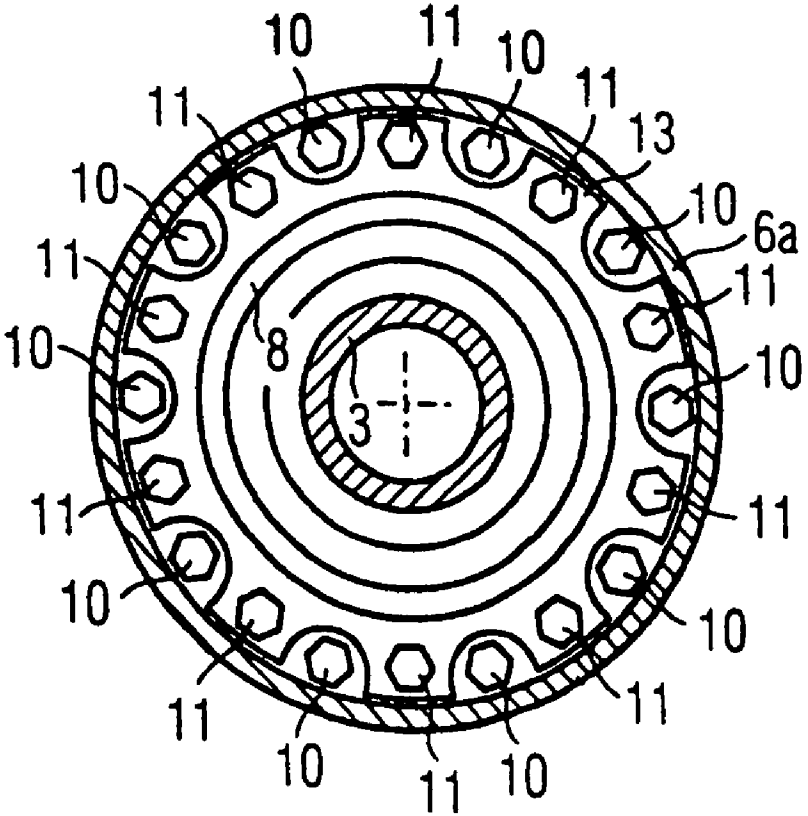
FIG. 3 shows a section through the switching device shown in FIGS. 1 and 2, along the axis A-A.

FIG. 3 shows a section along the sectional plane A-A illustrated in FIGS. 1 and 2. The pressure element 13 has a structure which is in the form of an annular disk and which has cutouts, through which the further bolts 11 pass. The pressure element 13 is pressed against the projection 12 by means of the further bolts 11, with the interposition of the projecting shoulder of the insulating material nozzle 8. Furthermore, the pressure element 13 is designed such that, in order to achieve a small total diameter for the arrangement, the pressure element 13 has lateral notches in order to make it possible to fix the ring 9 by means of the bolts 10. This design makes it possible to fix the ring 9 or the insulating material nozzle 8 independently of one another. As a result, the two connections are decoupled from one another. Any interference or thermal expansions etc. at one connection point are thus largely kept away from the other connection.

We claim:

1. A switching device, comprising:

a first and a second arcing contact piece, lying axially opposite one another;

a first and a second rated current contact piece, disposed coaxially with respect to said arcing contact pieces, at least one of said rated current contact pieces having a hollow-cylindrical basic body formed with a substantially continuous outer circumferential wall having a front end;

an arc-resistant material covering said front end, said arc-resistant material having an electroplated surface; and contact-making points disposed between said first and second rated current contact pieces and lying axially in a region of said electroplated surface in a switched-on state of the switching device;

said electroplated surface making initial contact with said contact-making points and making contact with said contact-making points in the switched-on state of the switching device and wherein said arc-resistant material is made of a plurality of different metals, and said arc-resistant material is fixed to said hollow-cylindrical basic body in a form of a ring so as to cover said front end of said circumferential wall of said hollow-cylindrical basic body, wherein said ring has a smaller radial wall thickness at a further end facing away from said switching path than at an end facing said switching path.

2. The switching device according to claim 1, further comprising a bolt connection, said ring being pressed against said hollow-cylindrical basic body in a axial direction by said bolt connection.

3. The switching device according to claim 1, further comprising an insulating body;

further comprising a pressure element; and wherein said hollow-cylindrical basic body has a radial projection, against which said insulating body, is pressed axially by said pressure element.

4. The switching device according to claim 3, wherein said circumferential wall of said hollow-cylindrical basic body has an inner casing side and a reduced outer diameter at said front end facing said switching path, said radial projection is disposed on said inner casing side in a region of said reduced outer diameter.

5. The switching device according to claim 1, wherein said ring has an enlarged radial wall thickness region and fixing devices in a region of said enlarged radial wall thickness region.

6. The switching device according to claim 3, wherein said insulating body is an insulating material nozzle.

7. The switching device according to claim 3, wherein said plurality of different metals of said arc-resistant material form a surface, and said electroplated surface is electroplated directly on said surface formed by said plurality of different metals of said arc-resistant material.

8. A switching device, comprising:

a first and a second arcing contact piece, lying axially opposite one another;

a first and a second rated current contact piece, disposed coaxially with respect to said arcing contact pieces, at least one of said rated current contact pieces having a hollow-cylindrical basic body formed with a substantially continuous outer circumferential wall having a front end;

an arc-resistant material covering said front end, said arc-resistant material having an electroplated surface;

contact-making points disposed between said first and second rated current contact pieces and lying axially in a region of said electroplated surface in a switched-on state of the switching device; and a ring attached to said front end of said circumferential wall of said hollow-cylindrical basic body;

said ring made of said arc-resistant material;

said electroplated surface making initial contact with said contact-making points and making contact with said contact-making points in the switched-on state of the switching device and wherein said arc-resistant material is made of a plurality of different metals.

* * * * *